US010399741B2

(12) United States Patent
De Villiers

(10) Patent No.: US 10,399,741 B2
(45) Date of Patent: Sep. 3, 2019

(54) COLLAPSIBLE BULK CONTAINER

(71) Applicant: Gregory John De Villiers, Simondium (ZA)

(72) Inventor: Gregory John De Villiers, Simondium (ZA)

( * ) Notice: Subject to any disclaimer, the term of this patent is extended or adjusted under 35 U.S.C. 154(b) by 156 days.

(21) Appl. No.: 15/520,288

(22) PCT Filed: Sep. 5, 2015

(86) PCT No.: PCT/IB2015/056793

§ 371 (c)(1),
(2) Date: Apr. 19, 2017

(87) PCT Pub. No.: WO2016/035056

PCT Pub. Date: Mar. 10, 2016

(65) Prior Publication Data

US 2017/0327270 A1 Nov. 16, 2017

(30) Foreign Application Priority Data

Sep. 5, 2014 (ZA) ..... 2014/06543

(51) Int. Cl.
*B65D 19/12* (2006.01)
*B65D 19/38* (2006.01)
(Continued)

(52) U.S. Cl.
CPC ..... *B65D 19/12* (2013.01); *B65D 19/385* (2013.01); *B65D 21/0209* (2013.01); *B65D 85/34* (2013.01); *B65D 2519/00024* (2013.01); *B65D 2519/00059* (2013.01); *B65D 2519/0087* (2013.01); *B65D 2519/0091* (2013.01); *B65D 2519/00094* (2013.01); *B65D 2519/0096* (2013.01); *B65D 2519/0097* (2013.01);
(Continued)

(58) Field of Classification Search
CPC ..... B65D 19/12; B65D 2519/0087; B65D 2519/00532; B65D 2519/00298; B65D 2519/0091
See application file for complete search history.

(56) References Cited

U.S. PATENT DOCUMENTS 5,437,384 A * 8/1995 Farrell ..... B65D 19/12 220/1.5
5,746,343 A 5/1998 Waltke et al.

FOREIGN PATENT DOCUMENTS

| | | |
|---|---|---|
| WO | 9641754 | 12/1996 |
| WO | 03033380 | 4/2003 |
| WO | 2012027778 | 3/2012 |

OTHER PUBLICATIONS

International Patent Application No. PCT/IB2015/056793, International Search Report dated Nov. 16, 2015, 2 pages.
(Continued)

*Primary Examiner* — Andrew T Kirsch
*Assistant Examiner* — Don M Anderson
(74) *Attorney, Agent, or Firm* — Kilpatrick Townsend & Stockton LLP

(57) ABSTRACT

A collapsible bulk container 10 comprising a bag 12 for holding a bulk load, a support base 14, four collapsible legs 16 and a rectangular upper frame member 18. The legs 16 are secured to the support base 14 by means of hinge assemblies 20 which permit hinged displacement of the legs between upright positions and folded positions wherein the legs are folded onto the support base 14.

8 Claims, 19 Drawing Sheets

(51) Int. Cl.
*B65D 21/02* (2006.01)
*B65D 85/34* (2006.01)

(52) U.S. Cl.
CPC ..... *B65D 2519/00233* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00497* (2013.01); *B65D 2519/00532* (2013.01); *B65D 2519/00587* (2013.01); *B65D 2519/00691* (2013.01); *B65D 2519/00796* (2013.01)

(56) References Cited

OTHER PUBLICATIONS

International Patent Application No. PCT/IB2015/056793, International Preliminary Report on Patentability dated Mar. 7, 2017, 4 pages.

* cited by examiner

COLLAPSIBLE BULK CONTAINER

CROSS-REFERENCE TO RELATED APPLICATIONS

This is a U.S. national phase under 35 U.S.C. 371 of International Patent Application No. PCT/IB2015/056793 titled "A Collapsible Bulk Container" and filed Sep. 5, 2015, which claims priority to South Africa Patent Application No. 2014/06543, filed Sep. 5, 2014, the entireties of which are incorporated herein by reference.

FIELD OF INVENTION

This invention relates to a collapsible bulk container.

SUMMARY OF INVENTION

According to the invention there is provided a collapsible bulk container including:

a bag for holding a bulk load;

a support base;

a number of collapsible legs which are hingedly secured to the support base, the legs being displaceable between extended positions wherein the legs extend upwardly from the support base and collapsed positions wherein the legs are disposed adjacent the support base; and an upper frame member releasably attached to upper ends of the legs when the legs are in the extended positions thereof, the upper frame member defining a central opening which is in register with a mouth of the bag.

The support base may have a quadrilateral shape when viewed in plan view, wherein four corners are defined by the support base.

The bulk container may include four collapsible legs wherein each leg is hingedly secured to the support base near a different one of the corners of the support base.

The upper frame member may have a quadrilateral shape corresponding to the quadrilateral shape of the support base. More specifically, the upper frame member may have an open framework structure comprising four elongate frame elements connected to one another at corners of the upper frame member. The upper frame member may be releasably secured to upper ends of the legs at corners of the upper frame member thereby to provide an elevated support structure from which the bag is supported in an arrangement wherein the mouth of the bag is held open by the upper frame member. More specifically, the upper frame member and the legs may have complementary engagement formations for releasably securing the upper frame member to the upper ends of the legs when the legs are in the extended positions thereof.

The frame member and the legs may be configured such that the lower end of the bag is spaced above an upper side of the support base.

The bag may be of a flexible sheet material.

In a particular application, the bulk container may be adapted, but not necessarily exclusively, for holding fruit or other fragile articles which may be susceptible to damage if not handled with care. In another application, the bulk container may be adapted to hold bulk liquid or other pourable material such as, for example, fertilizer.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DESCRIPTION OF PREFERRED EMBODIMENTS

Figure 1:
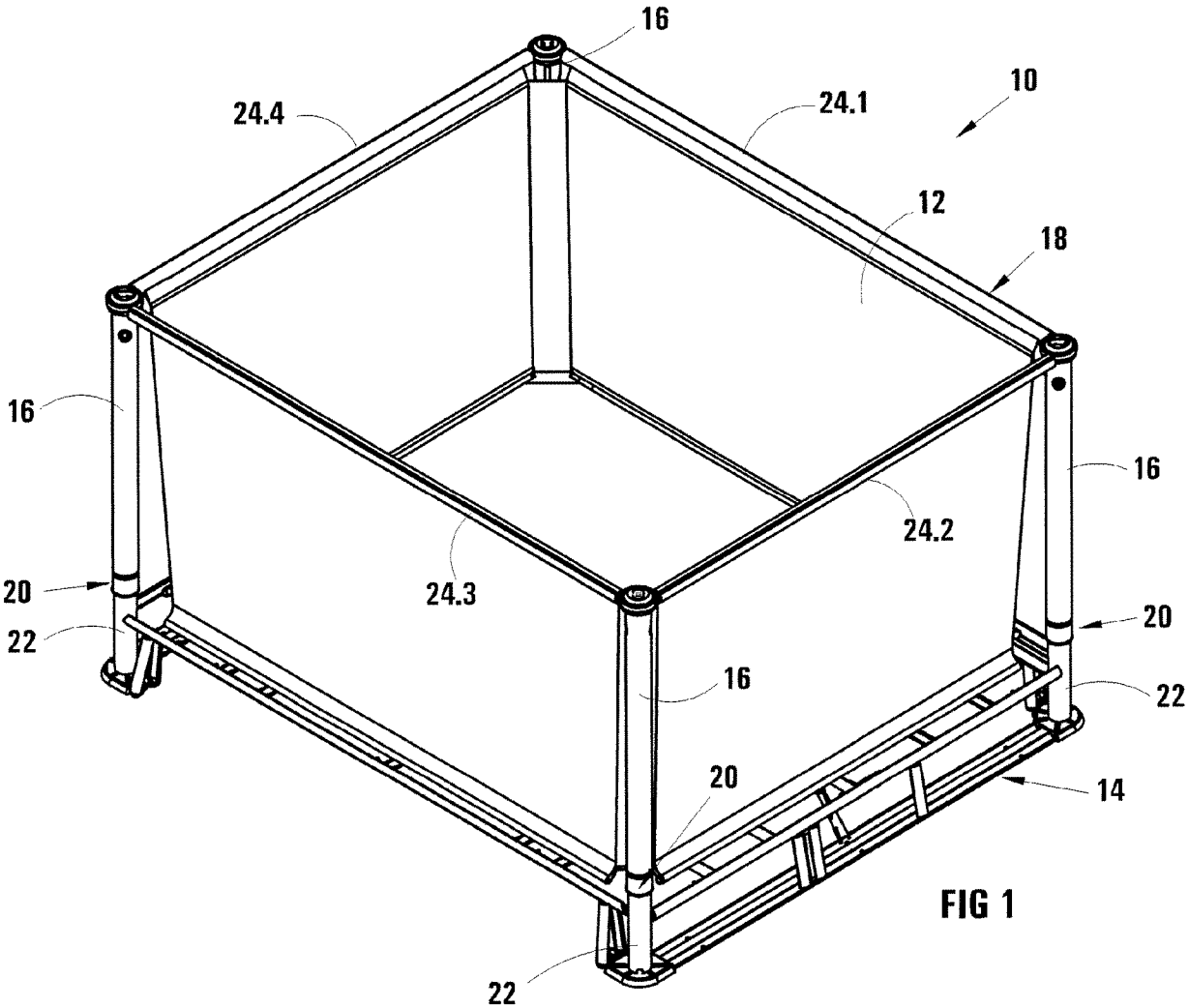
FIG. 1 shows a three-dimensional view of a collapsible bulk container in accordance with the invention, with the legs in extended positions.

With reference to the drawings, a collapsible bulk container and accordance with the invention, is designated generally by the reference numeral 10. The container 10 comprises, broadly, a bag 12 for holding a bulk load, a support base 14, four collapsible legs 16 and a rectangular upper frame member 18. The container 10 is adapted for holding fragile articles such as harvested fruit, which may be susceptible to damage if not handled with care.

The bag 12 is of a flexible sheet material rendering the bag foldable. The Applicant envisages that the material of the bag may have impact absorption properties.

The support base 14 has a rectangular profile when viewed in plan view which corresponds to the rectangular profile of the upper frame member 18. The configuration of the support base is essentially conventional and defines openings therein within which the tines of a forklift or other material handling/lifting device can be received. The support base has an upright corner post 22 at each corner and a socket formation 23 which opens onto an underside of the support base.

Figure 2:
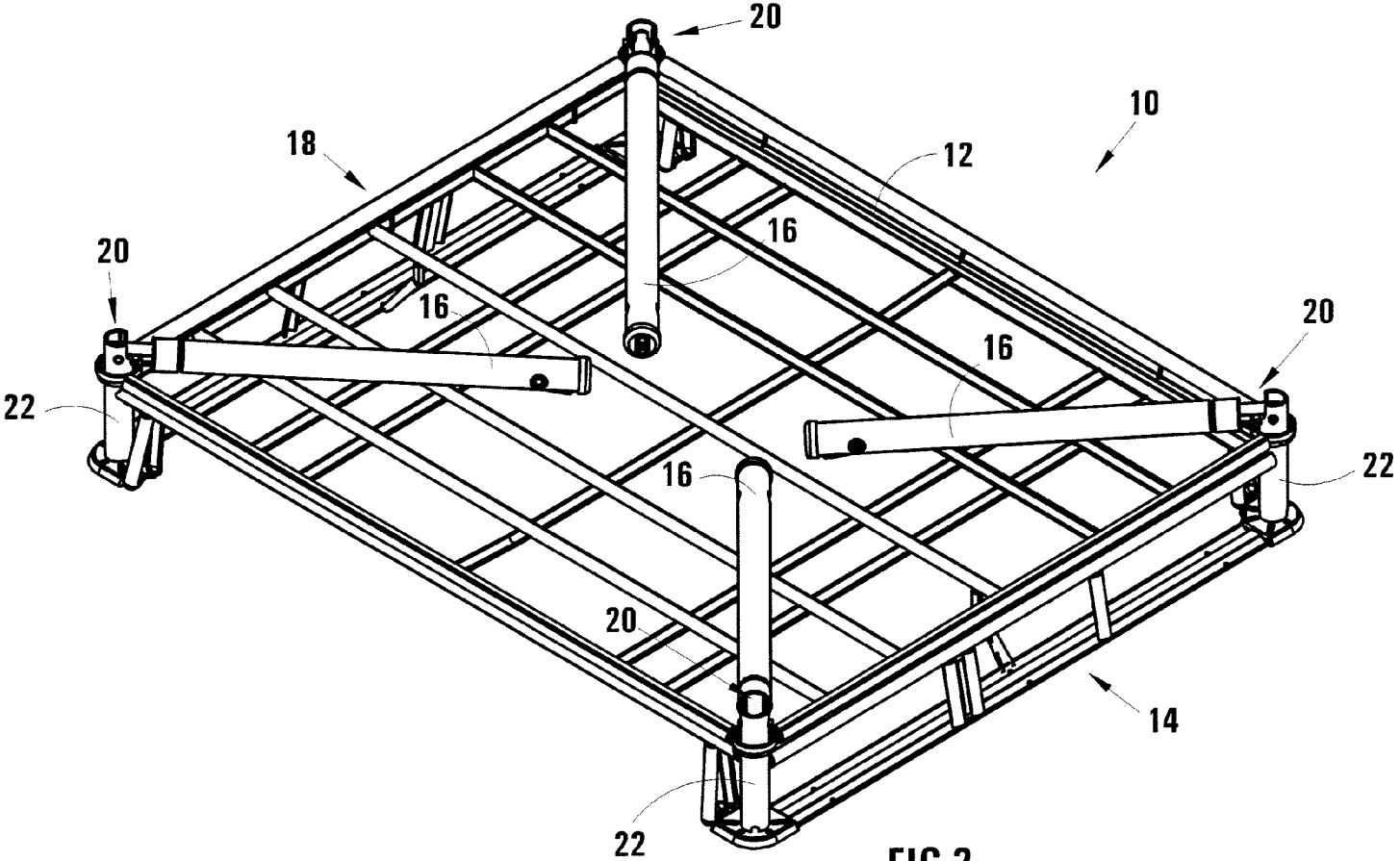
FIG. 2 shows a three-dimensional view of the collapsible bulk container of FIG. 1, with the legs in collapsed positions.
Figure 3:
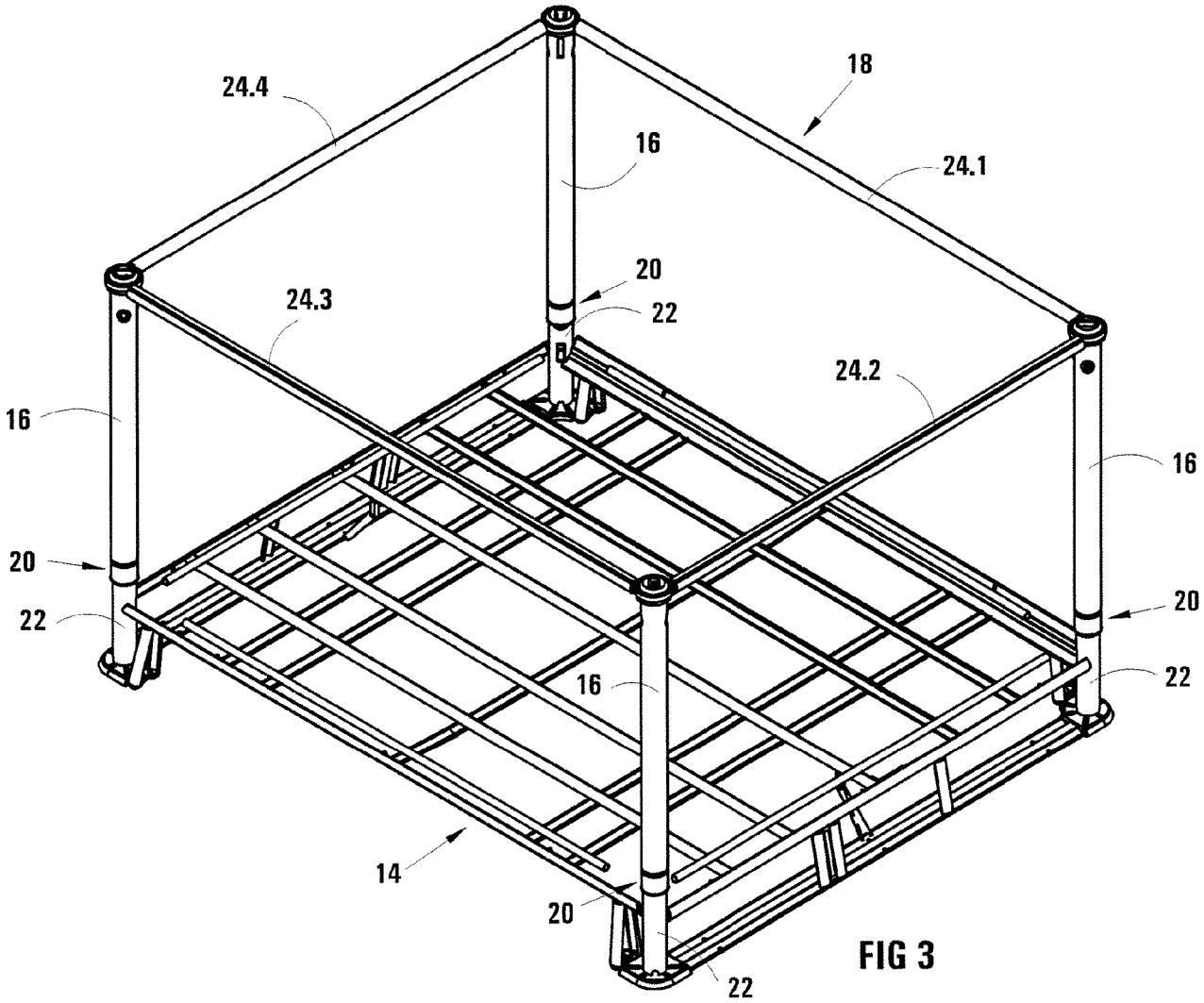
FIG. 3 shows a three-dimensional view of the collapsible bulk container of FIG. 1, with the bag removed.
Figure 4:
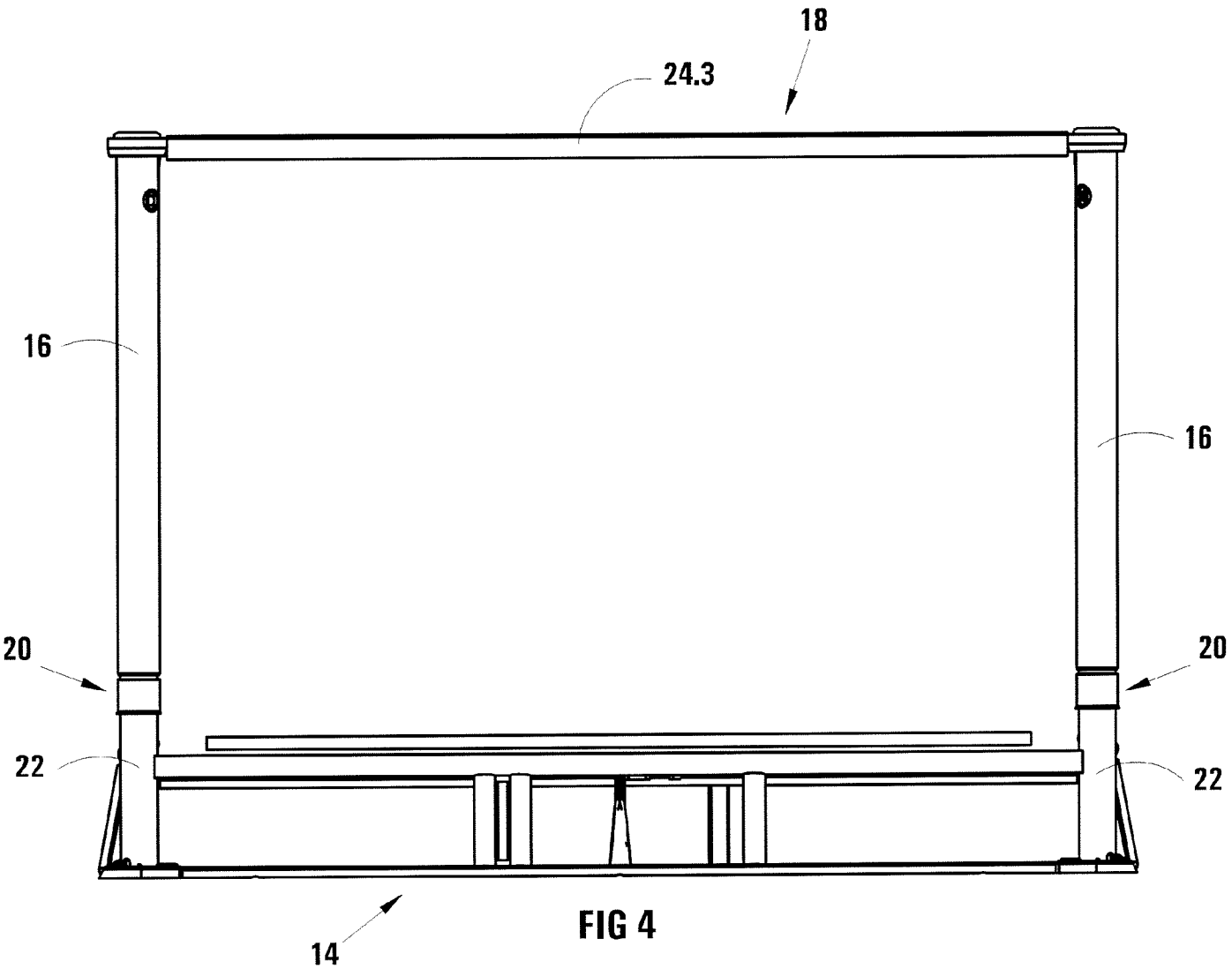
FIG. 4 shows a side view of the collapsible bulk container of FIG. 3.
Figure 5:
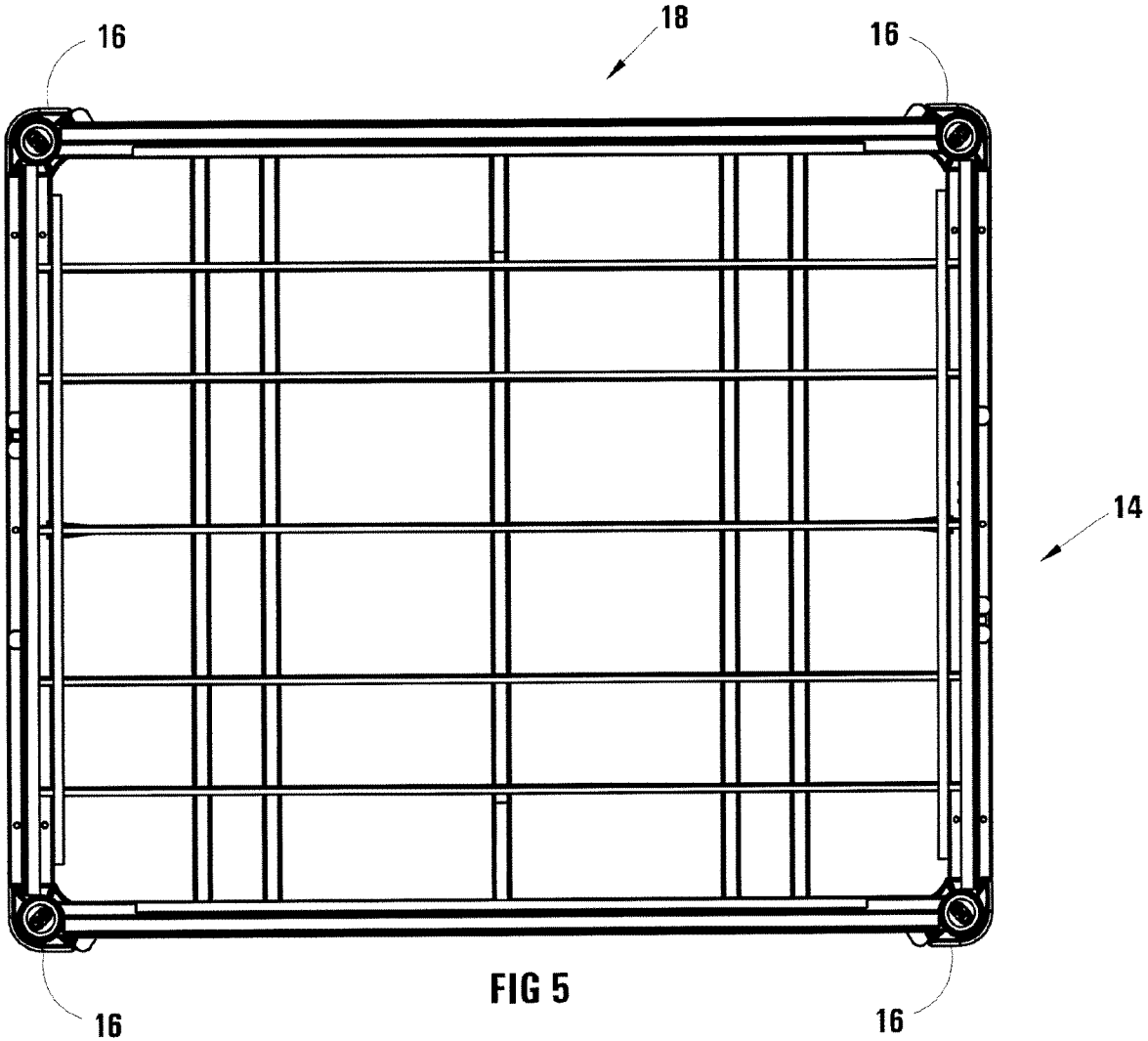
FIG. 5 shows a top plan view of the collapsible bulk container of FIG. 3.
Figure 6:
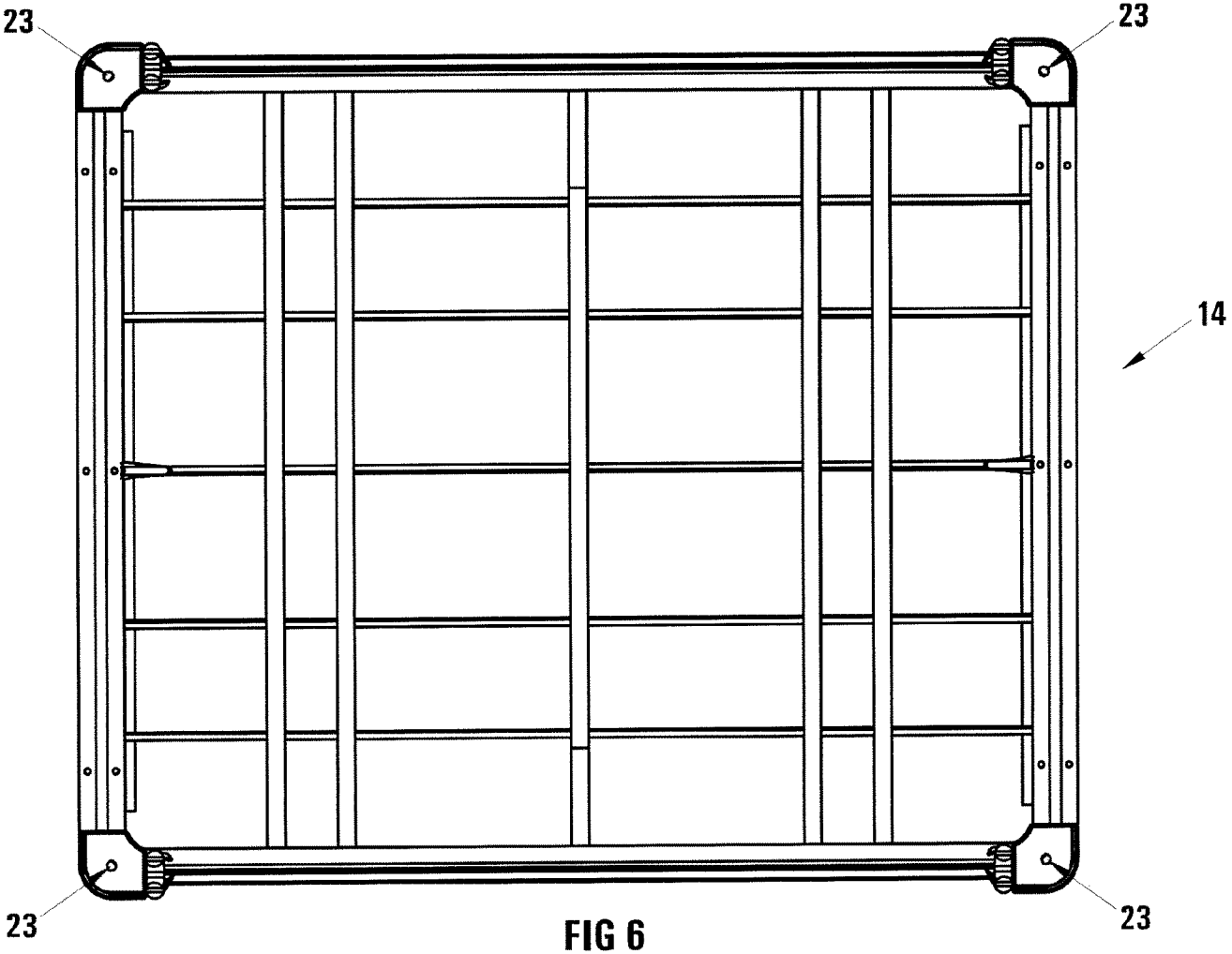
FIG. 6 shows a bottom plan view of the collapsible bulk container of FIG. 3.
Figure 7:
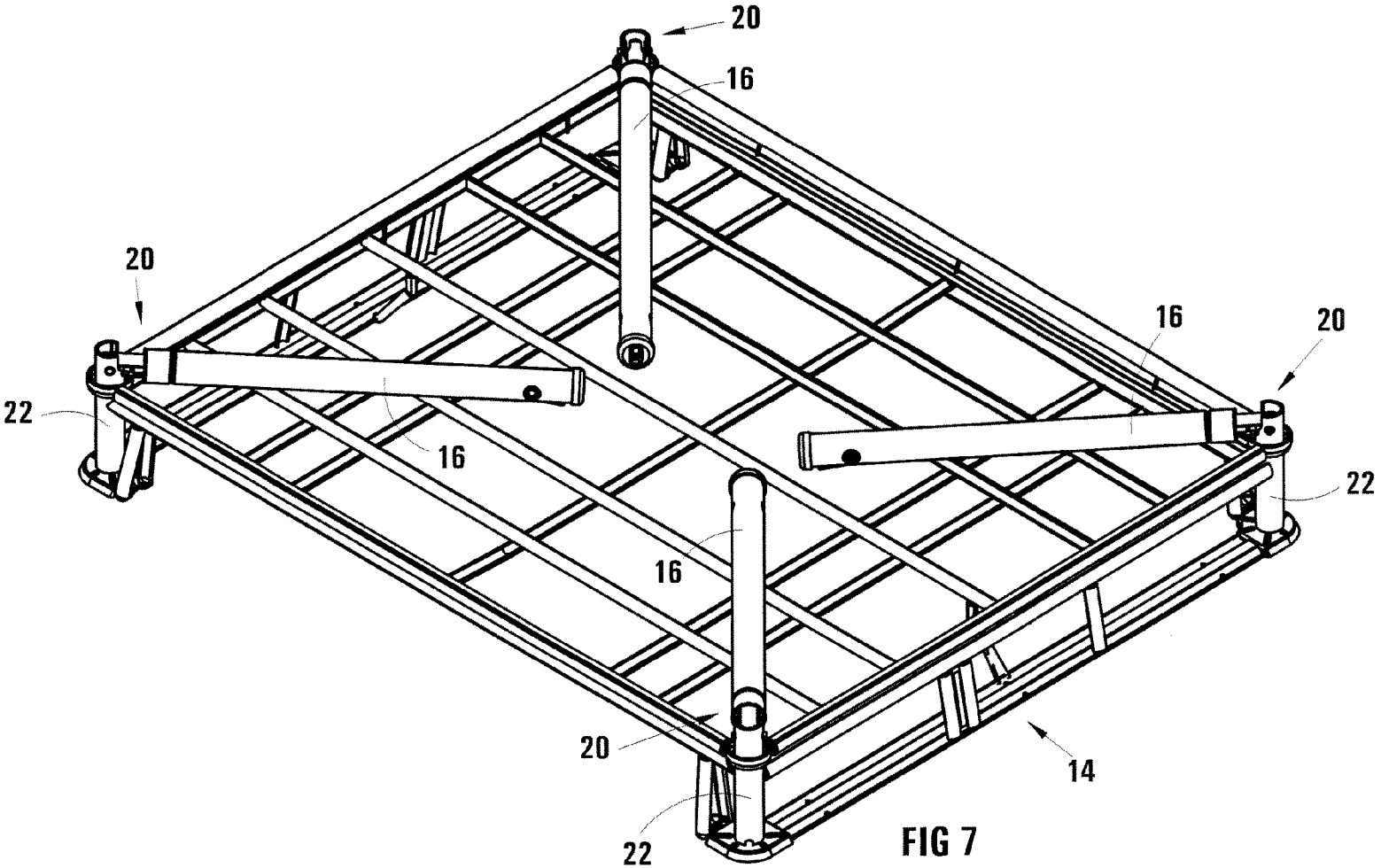
FIG. 7 shows a three-dimensional view of the collapsible bulk container of FIG. 1, with the bag and the upper frame member removed and the legs in collapsed positions.
Figure 8:
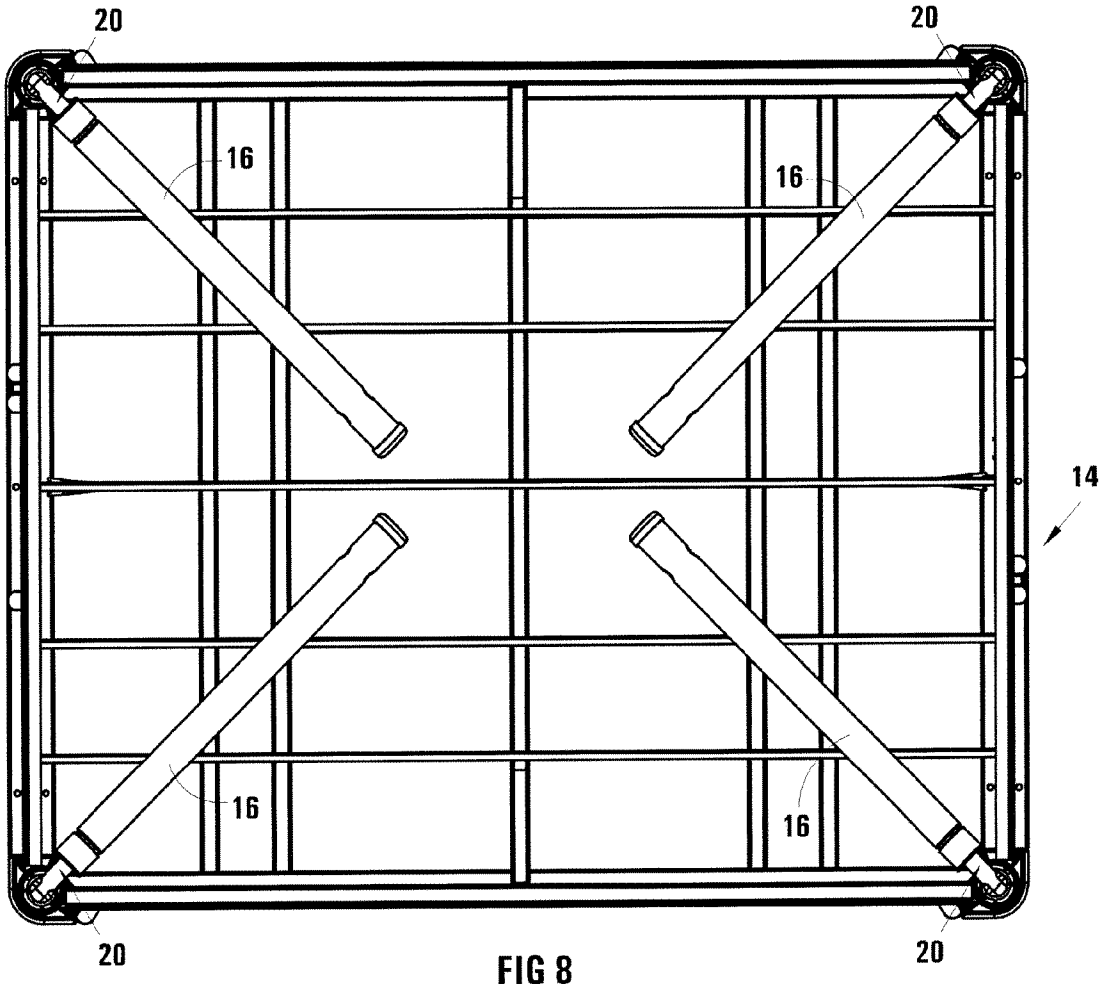
FIG. 8 shows a top plan view of the collapsible bulk container of FIG. 7.
Figure 9:
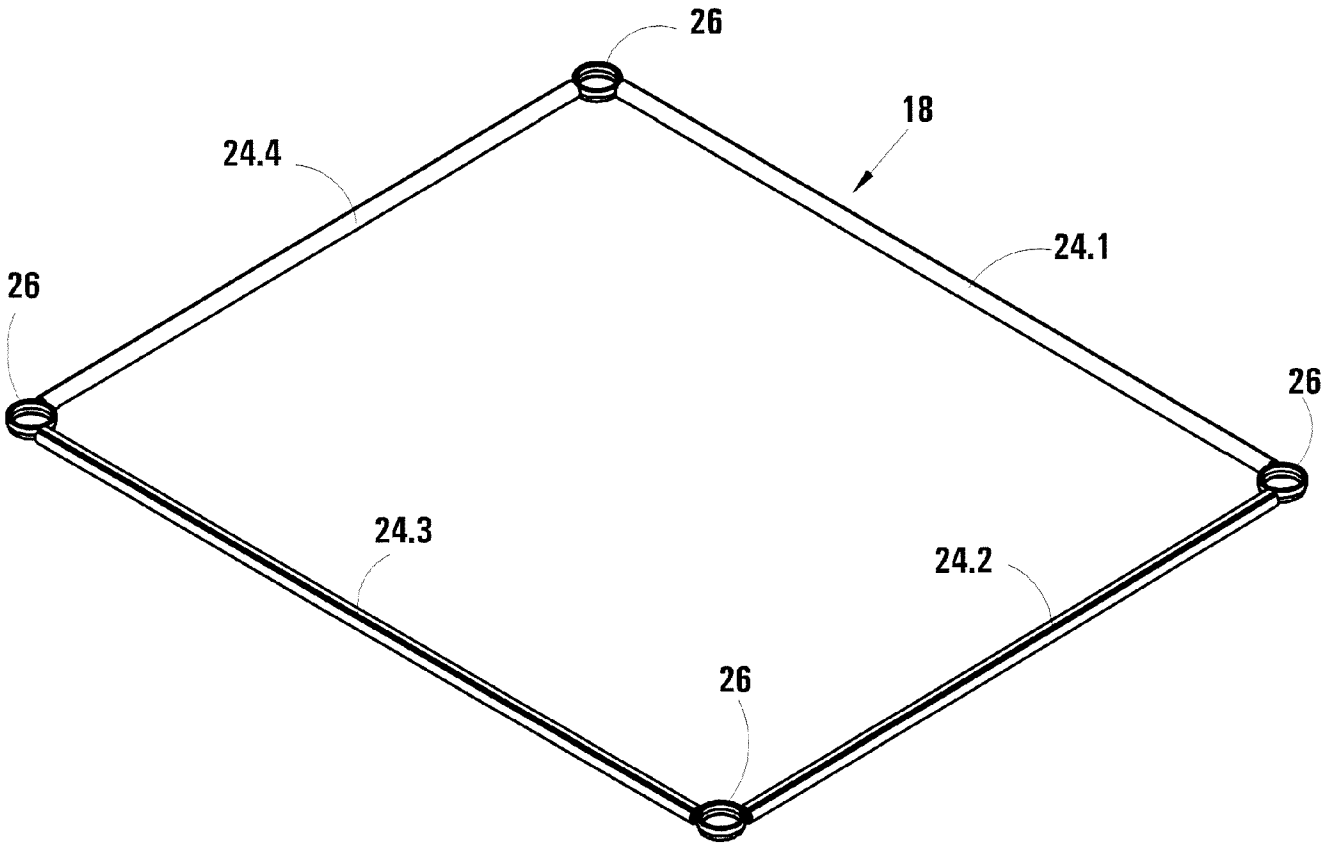
FIG. 9 shows a three-dimensional view of the upper frame member of the collapsible bulk container of FIG. 1.
Figure 10:
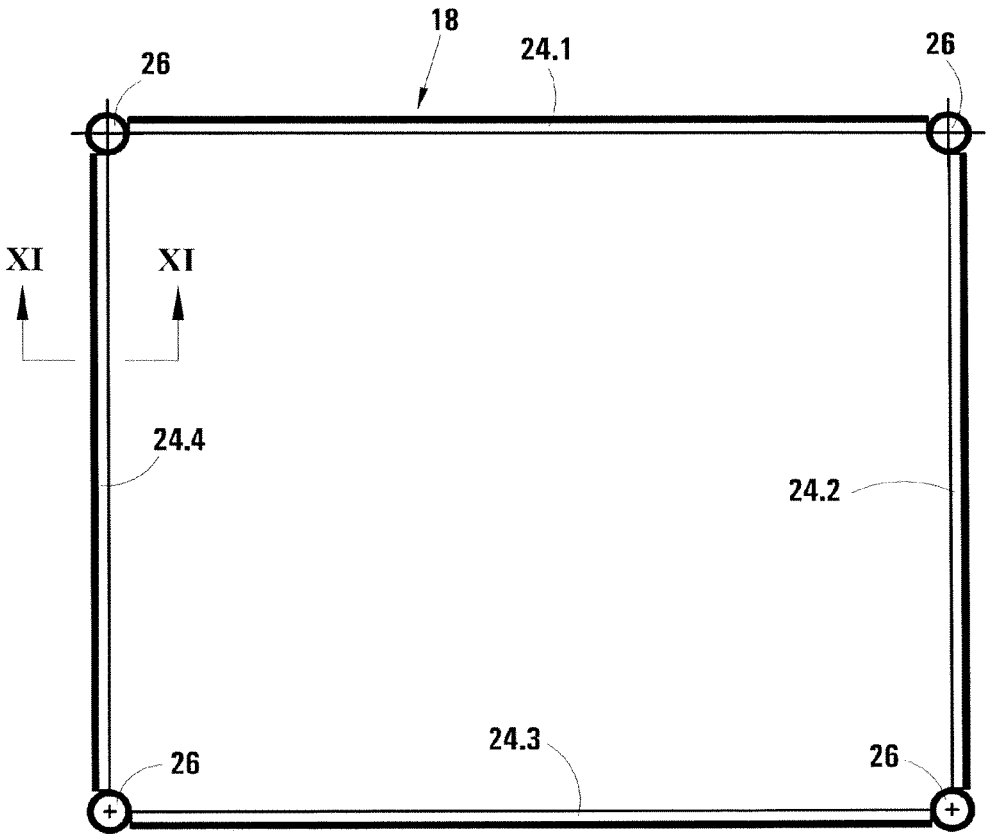
FIG. 10 shows a top plan view of the upper frame member of FIG. 9.
Figure 11:
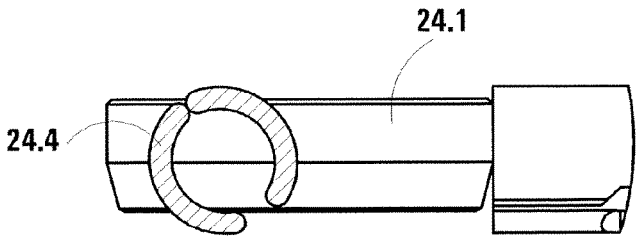
FIG. 11 shows an enlarged sectional end view of the frame member of FIG. 9, sectioned along section line XI-XI of FIG. 10.
Figure 12:
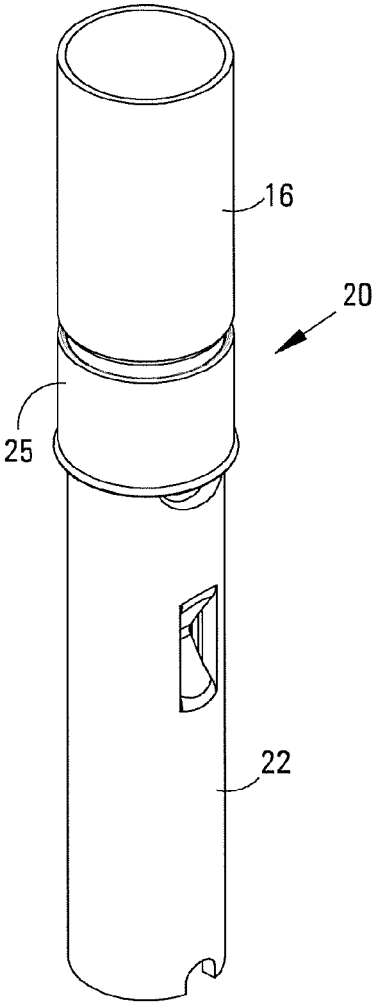
FIG. 12 shows a fragmentary three-dimensional view of a hinge assembly of one of the legs of the collapsible bulk container of FIG. 1.
Figure 13:
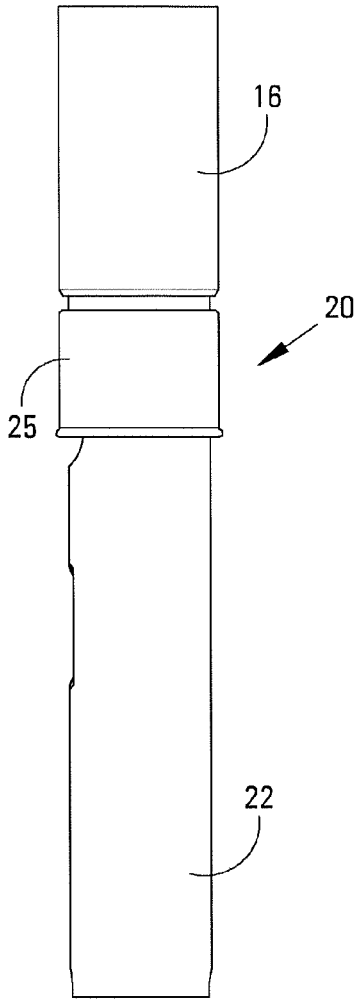
FIG. 13 shows a side view of the hinge assembly of FIG. 12.
Figure 14:
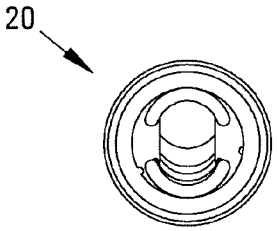
FIG. 14 shows a top plan view of the hinge assembly of FIG. 13.
Figure 15:
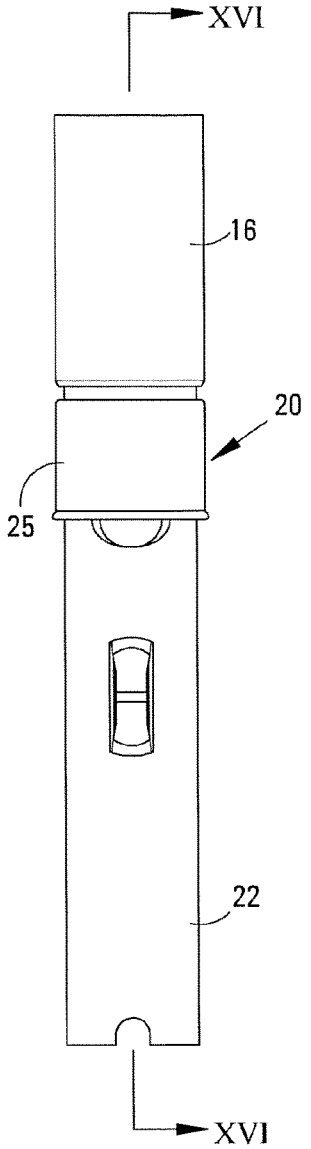
FIG. 15 shows another side view of the hinge assembly of FIG. 12.
Figure 16A:
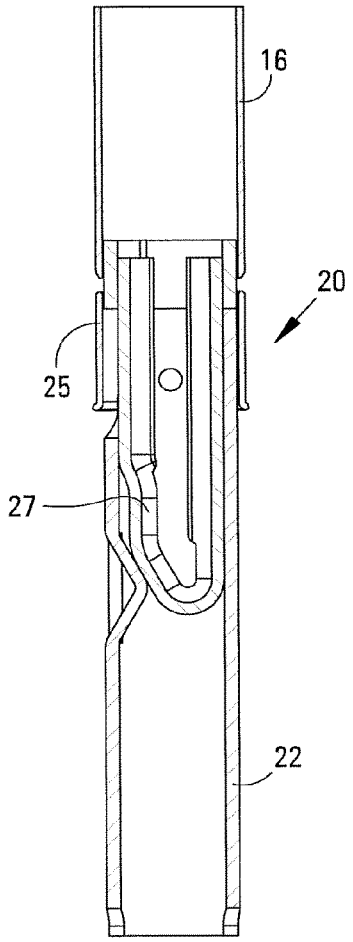
FIGS. 16A-16E show sectional side views of the hinge assembly of FIG. 12, sectioned along section line XVI-XVI of FIG. 15, illustrating, in sequence, the operation of the hinge assembly.
Figure 16B:
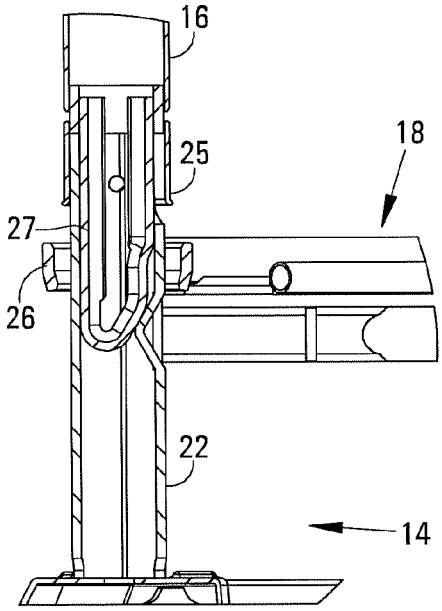
Figure 16C:
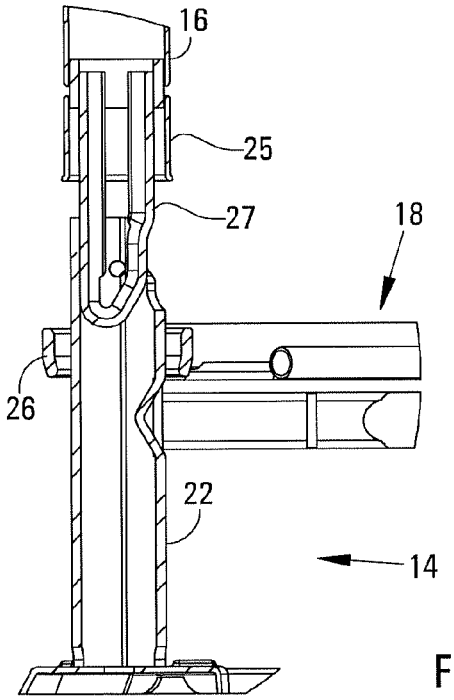
Figure 16D:
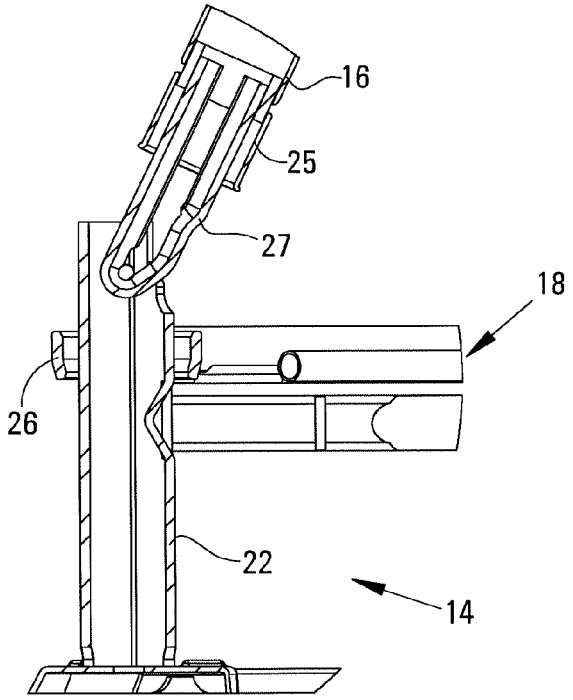
Figure 16E:
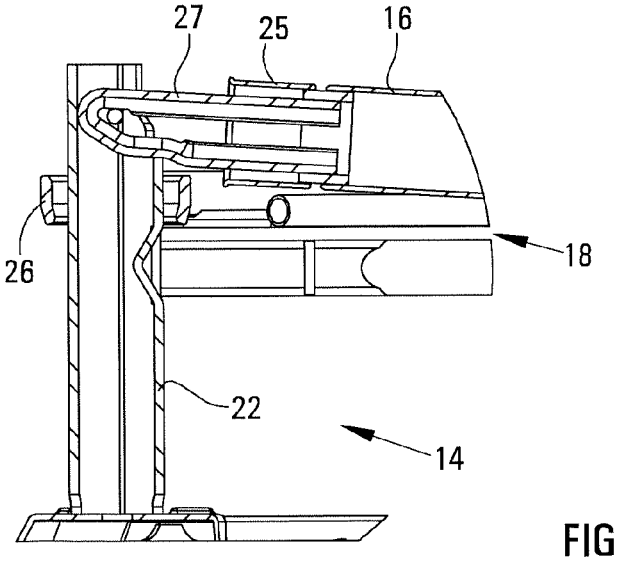

The legs 16 each have a hollow tubular metal construction and are secured to the support base 14 by means of hinge assemblies 20. The hinge assemblies permit hinged displacement of the legs between extended positions (as is shown in FIGS. 1, 3 and 4 of the drawings) wherein the legs extend perpendicularly relative to a plane defined by an upper surface of the support base and collapsed positions (as is shown in FIGS. 2, 7 and 8 of the drawings) wherein the legs are disposed adjacent the support base. Each leg 16 is hingedly secured to a corner post 22 of the support base by means of a hinge assembly 20.

The hinge assembly 20 of each leg comprises an outer cover 25 and an inner hinge formation 27 which is pivotally mounted to an upper end of the corner post 22 associated with the leg. In FIGS. 16A-16E, the manner in which the hinge assembly is pivotally displaced for displacing a leg 16 associated with the hinge assembly between an upright position and folded over position wherein the leg is folded onto the support base 14, is illustrated in sequence.

The upper frame member is of a metal construction and has an open framework structure comprising four elongate frame elements 24.1, 24.2, 24.3 and 24.4 which are connected to one another at corners of the upper frame member by means of collars 26. The collars of the upper frame member are each releasably secured to the upper end of a different leg thereby providing an elevated support structure from which the bag 12 is supported in an arrangement wherein the mouth of the bag is held open by the upper frame member. The dimensions of the bag and the lengths of the legs are such that a lower end of the bag is spaced above an upper side of the support base.

Each frame element has a hollow partly cylindrical configuration, with a longitudinal slit 21 being defined in a wall of the frame element through which an upper edge region of the bag 12 can be inserted and held within the hollow interior of the frame element. The frame elements thus serve to hold the mouth of the bag open, in use.

Figure 17A:
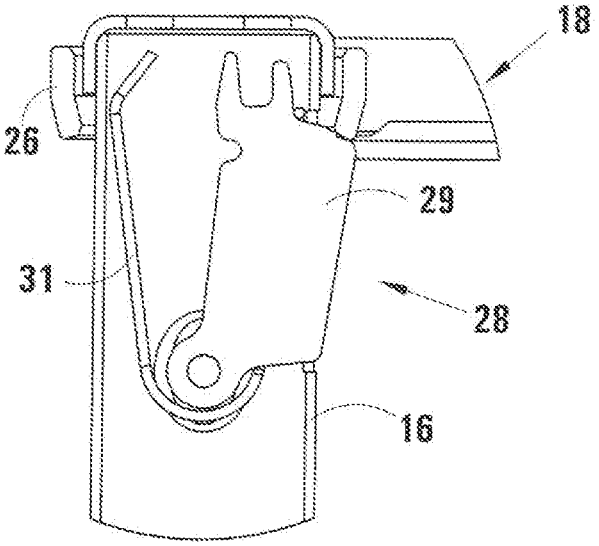
FIGS. 17A and B show sectional side views of the latch mechanism of one of the legs of the collapsible bulk container of FIG. 1.
Figure 17B:
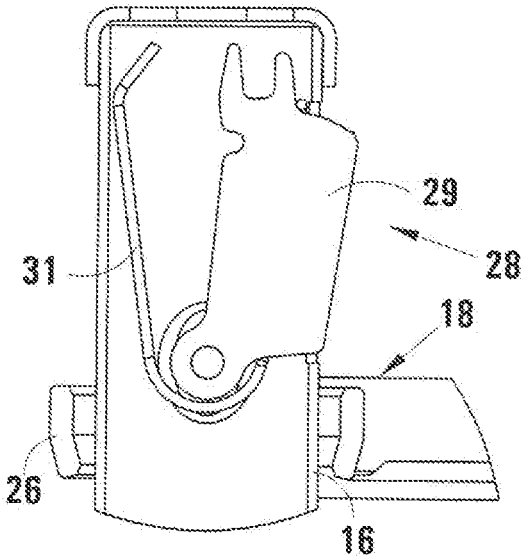

Each leg includes a latch mechanism 28 near the upper end thereof which is mounted within the hollow interior of the leg and includes a latch 29 which is displaceable under the influence of a torsion spring 31 between a projecting position as is shown in FIG. 17A wherein it abuts an underside of a collar 26 of the upper fame member thereby supporting the upper frame member relative to the legs when the legs are in their extended positions, and a retracted position wherein the latch mechanism is retracted into the hollow interior of the leg. In FIG. 17B, the upper frame member is shown below the latch mechanism after it has been slid downwardly along the legs past the latch.

Figure 18:
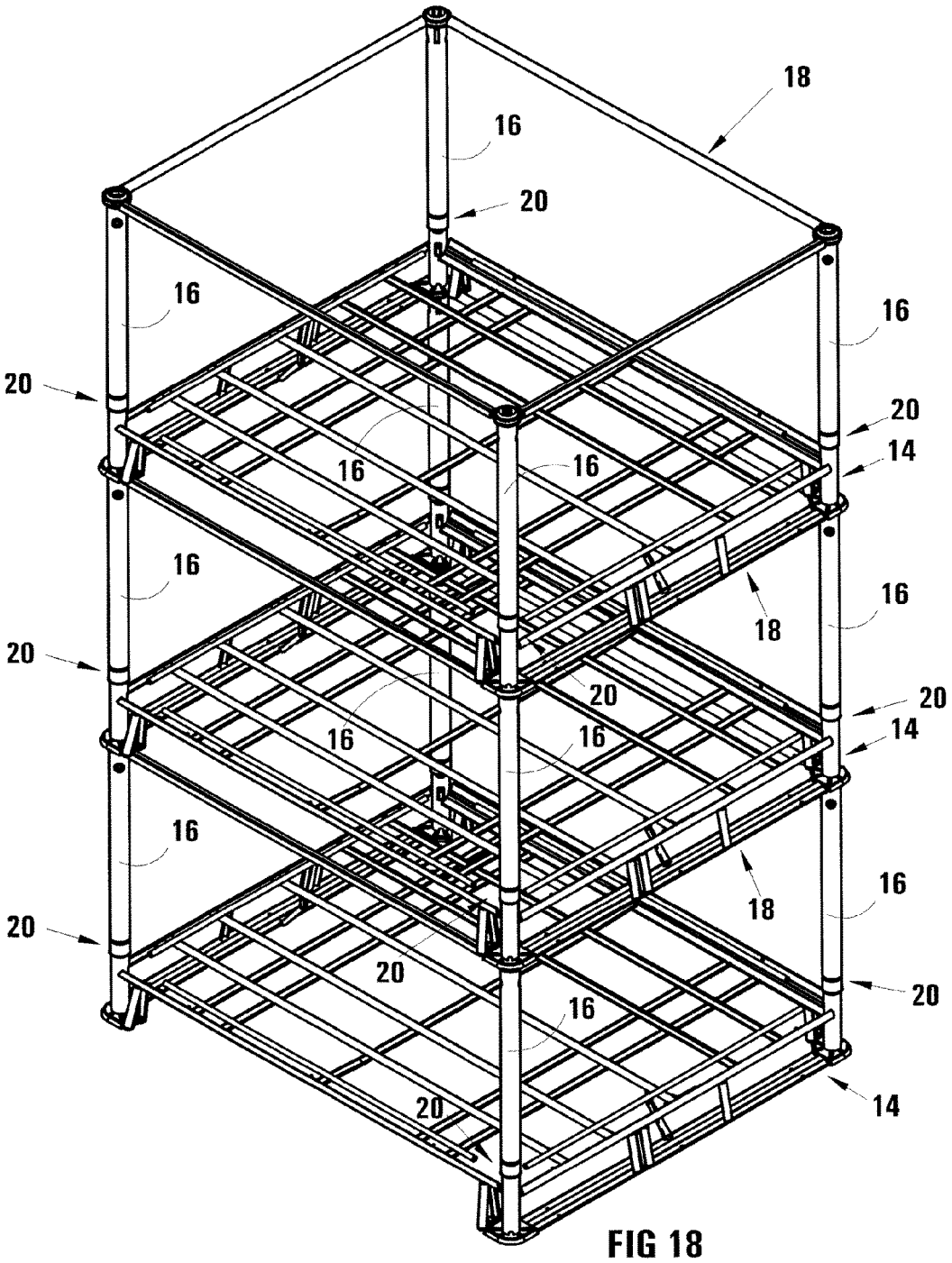
FIG. 18 shows a three-dimensional view of a number of the collapsible bulk containers of FIG. 1 with the bags removed and with the legs thereof in extended positions and stacked on top of one another.
Figure 19:
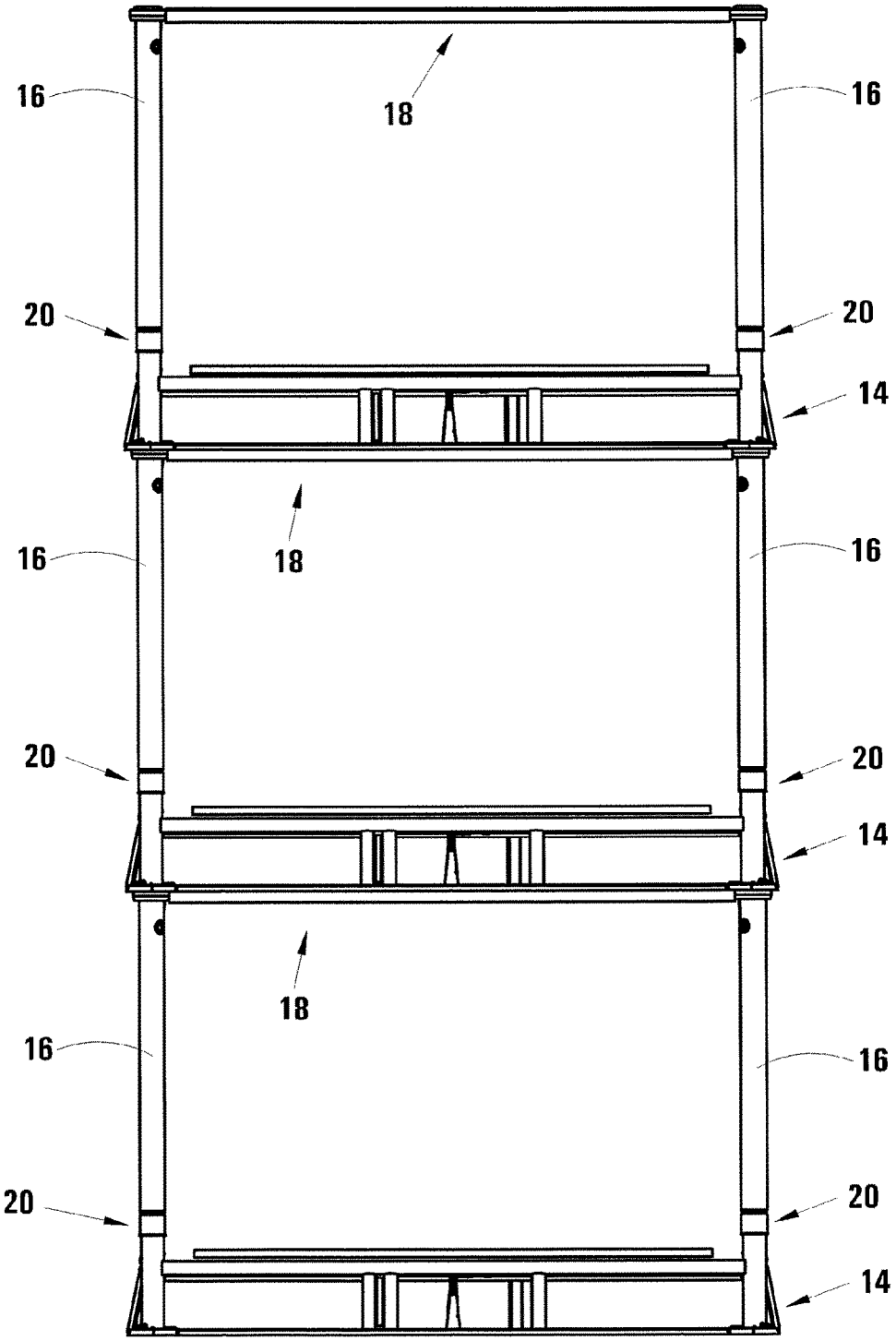
FIG. 19 shows a side view of the stacked collapsible bulk containers of FIG. 18.

With reference to FIGS. 18 and 19, the container 10 is stackable relative to other similar collapsible bulk containers when the legs of the container 10 are in their extended positions. In FIGS. 18 and 19, the manner in which a number of the containers 10 are stacked on top of one another, is illustrated. More particularly, upper ends of the legs of the containers are received in corresponding socket formations 23 of a container above and adjacent thereto in a stacked configuration of the containers.

Figure 20:
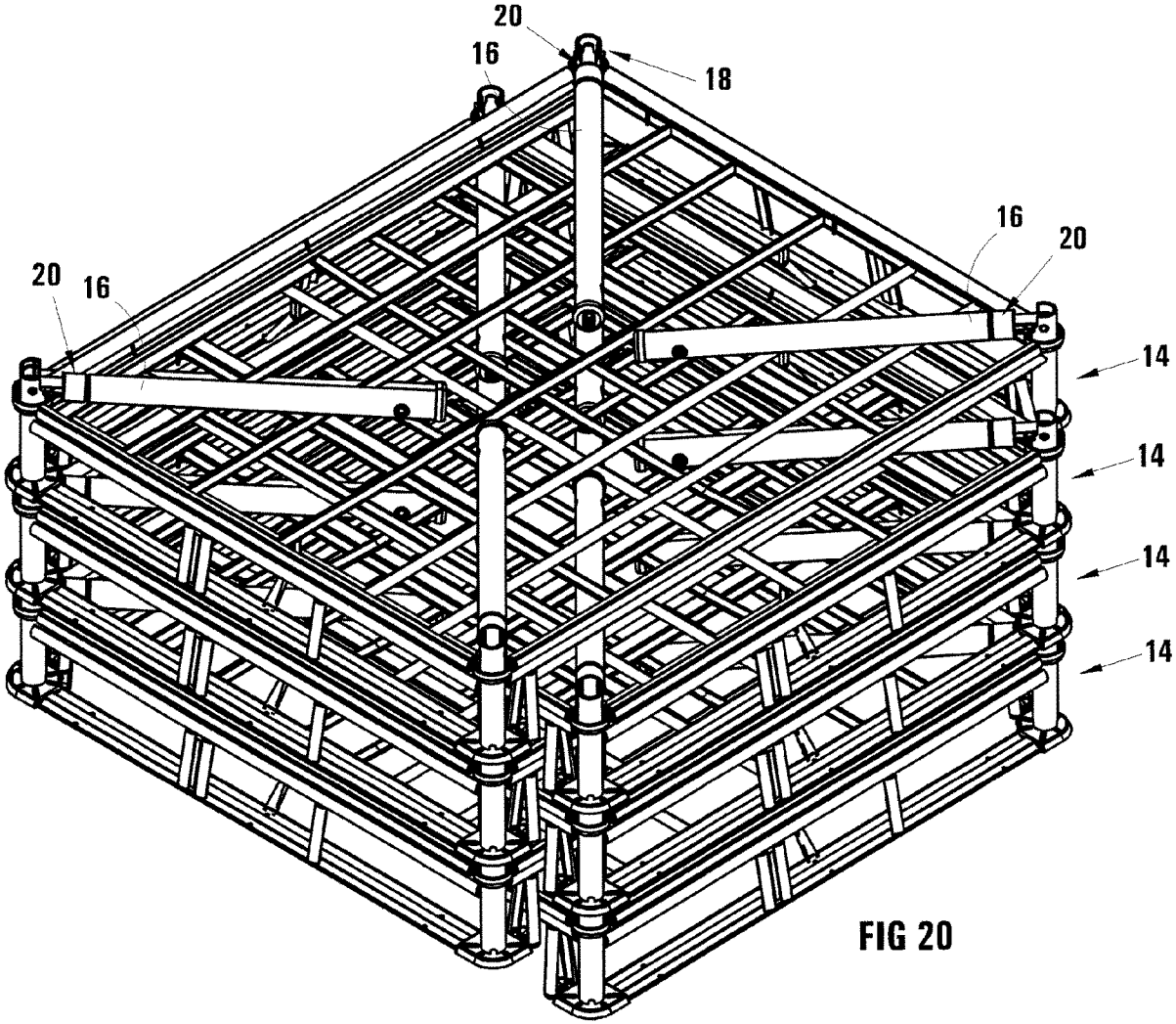
FIG. 20 shows a number of the collapsible bulk containers of FIG. 1 with the bags and the upper frame members removed and the legs thereof in collapsed positions and stacked on top of one another.
Figure 21:
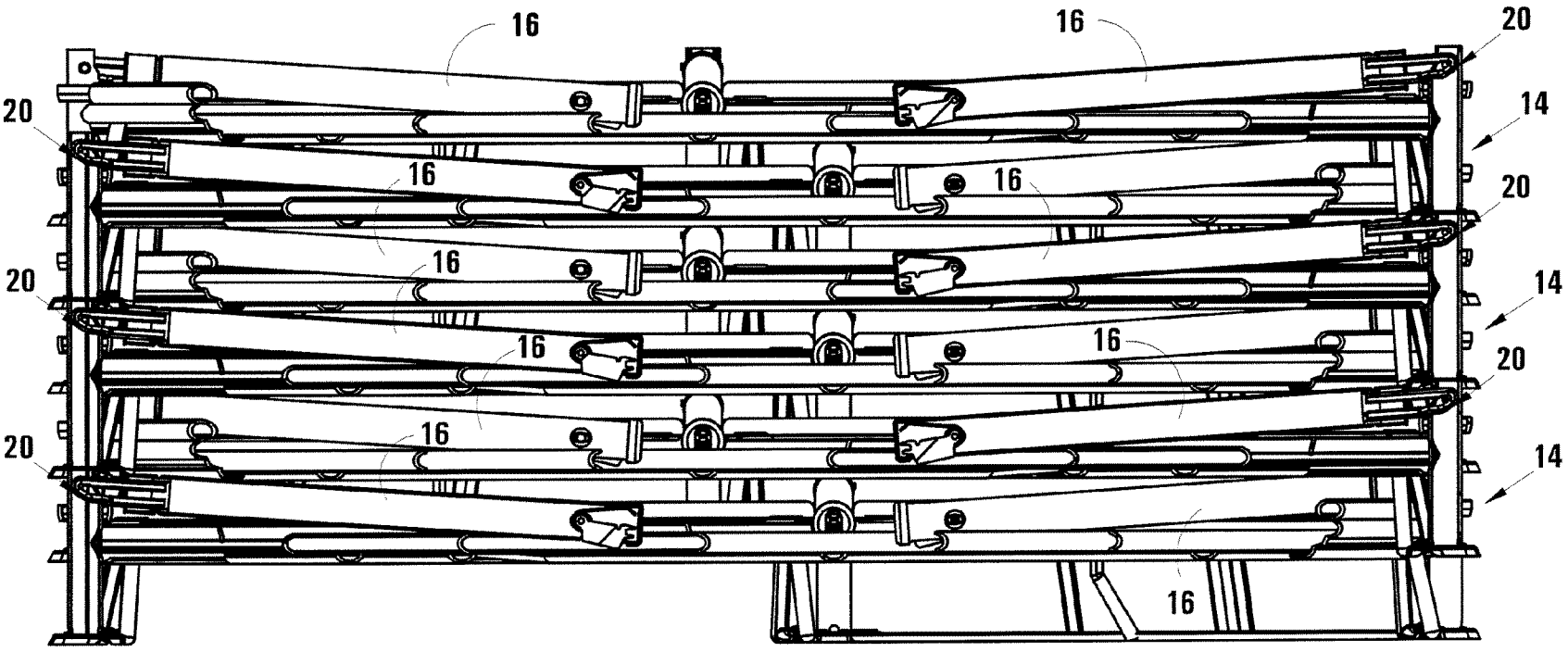
FIG. 21 shows a side view of the stacked collapsible bulk containers of FIG. 20.

With reference to FIGS. 20 and 21, the container 10 is also stackable relative to other similar collapsible bulk containers when the legs of the container 10 are in their collapsed positions. In FIGS. 20 and 21, the manner in which a number of the containers are stacked on top of one another, is illustrated. More particularly, upper ends of the outer support bodies 25 of the hinge assemblies 20 define spigot formations which are received in corresponding socket formations 23 of a container above and adjacent thereto in a stacked configuration of the containers.

In the application wherein the container 10 is adapted for holding fragile articles such as harvested fruit, the Applicant envisages that the material of the bag may be of flexible foraminous rubber sheet material, thereby further rendering the bag breathable. In another application wherein the bulk container is adapted for holding bulk liquid or other pourable material, such as, for example, fertilizer, the Applicant envisages that the flexible material of the bag may have suitable waterproof or liquid-impermeable properties.

The invention claimed is:

1. A collapsible bulk container including:

a bag for holding a bulk load comprising fragile articles in the form of fruit, the bag comprising a foraminous flexible sheet having impact absorption properties;

a support base which has a quadrilateral shape when viewed in plan view and wherein four corners are defined by the support base;

a number of collapsible legs which are hingedly secured to the support base, the legs being hingedly displaceable between extended positions wherein the legs extend upwardly from the support base and collapsed positions wherein the legs are disposed adjacent the support base; and an upper frame member which is slidably displaceable along the legs and releasably securable to the legs at upper ends thereof when the legs are in the extended positions thereof, the upper frame member defining a central opening which is in register with a mouth of the bag, thereby to provide an elevated support structure from which the bag is supported in an arrangement wherein the mouth of the bag is held open by the upper frame member, the upper frame member and the legs having complementary engagement formations for releasably securing the upper frame member to the upper ends of the legs when the legs are in the extended positions thereof, the upper frame member and the legs providing the elevated support structure from which the bag is supported in an arrangement wherein the bag is spaced above the support base and the mouth of the bag is held open by the upper frame member when the upper frame member is secured to the upper ends of the legs in the extended positions thereof.

2. The bulk container as claimed in claim 1, wherein the bulk container includes four collapsible legs wherein each leg is hingedly secured to the support base at a corresponding one of the corners of the support base.

3. The bulk container as claimed in claim 2, wherein the upper frame member has a quadrilateral shape corresponding to the quadrilateral shape of the support base.

4. The bulk container as claimed in claim 2, wherein the support base has a corner post located at each corner, with each leg being hingedly secured to a corresponding one of the corner posts by means of a hinge assembly which allows for said hinged displacement of the leg between the collapsed and extended positions thereof.

5. The bulk container as claimed in claim 2, wherein the upper frame member has a collar at each of the corners thereof, within which a corresponding one of the legs is slidably received when the legs are in their extended positions.

6. The bulk container as claimed in claim 5, wherein each of the legs includes one of the engagement formations near an upper end thereof for releasably engaging a particular one of the complementary engagement formations of the upper frame member at a corner of the upper frame member.

7. The bulk container as claimed in claim 6, wherein the engagement formation of each leg comprises a latch of a latch mechanism which is mounted to an upper end of the leg.

8. The bulk container as claimed in claim 7, wherein the complementary engagement formations of the upper frame member comprise the collars at each of the corners of the upper frame member, each collar being engaged by the latch of the leg which is slidably received within the collar.

* * * * *